US006265813B1

(12) United States Patent
Knox et al.

(10) Patent No.: US 6,265,813 B1
(45) Date of Patent: Jul. 24, 2001

(54) ELECTRODELESS LAMP WITH SEALED CERAMIC REFLECTING HOUSING

(75) Inventors: Richard M. Knox, Houston; William Burton Mercer, Spring; Dale S. Walker, Houston, all of TX (US)

(73) Assignee: Fusion Lighting, Inc., Rockville, MD (US)

( * ) Notice: Subject to any disclaimer, the term of this patent is extended or adjusted under 35 U.S.C. 154(b) by 0 days.

(21) Appl. No.: 09/319,308

(22) PCT Filed: Dec. 16, 1997

(86) PCT No.: PCT/US97/22304

§ 371 Date: Jun. 3, 1999

§ 102(e) Date: Jun. 3, 1999

(87) PCT Pub. No.: WO98/28780

PCT Pub. Date: Jul. 2, 1998

Related U.S. Application Data

(63) Continuation of application No. 08/771,757, filed on Dec. 20, 1996, now abandoned.

(51) Int. Cl.[7] ..... H01J 61/30; H01J 61/33; H01J 61/34

(52) U.S. Cl. ..... 313/113; 315/248; 313/607; 313/234; 313/634

(58) Field of Search ..... 313/110, 111, 313/112, 113, 114, 607, 234, 634, 573; 315/248; 362/19, 293, 296

(56) References Cited

U.S. PATENT DOCUMENTS

| | | | |
|---|---|---|---|
| 3,566,099 | 2/1971 | Makas | 240/9.5 |
| 3,631,288 | 12/1971 | Rogers | 313/112 |
| 3,763,392 | 10/1973 | Hollister | 315/248 |
| 3,860,854 | 1/1975 | Hollister | 315/248 |
| 4,429,249 | 1/1984 | Tyler et al. | 313/113 |
| 4,599,540 | 7/1986 | Roberts | 313/113 |
| 4,882,617 | 11/1989 | Vriens | 362/293 |
| 4,950,059 | 8/1990 | Roberts | 350/345 |
| 5,075,828 | 12/1991 | Gordin et al. | 313/114 |
| 5,404,076 | 4/1995 | Dolan et al. | 315/248 |
| 5,466,990 * | 11/1995 | Winsor | 313/493 |
| 5,479,069 | 12/1995 | Winsor | 313/493 |
| 5,500,574 | 3/1996 | Popov et al. | 315/248 |
| 5,519,285 | 5/1996 | Ukegawa et al. | 315/248 |
| 5,734,221 | 3/1998 | Van Os | 313/113 |
| 6,005,332 * | 12/1999 | Mercer | 313/573 |

FOREIGN PATENT DOCUMENTS

| | | | |
|---|---|---|---|
| 0871205 A1 | 10/1998 | (EP) | H01J/65/04 |
| WO 98/53475 | 11/1998 | (WO) | H01J/1/02 |

OTHER PUBLICATIONS

European Search Report dated Jan. 12, 2000.

* cited by examiner

*Primary Examiner*—Michael H. Day
(74) *Attorney, Agent, or Firm*—Paul E. Steiner

(57) ABSTRACT

An electrodeless lamp (10) for producing an intense beam of light includes a concave lamp body (11) that surrounds the lamp interior. A gas, such as sulfur or selenium or compounds thereof, is contained within the lamp body (11) for forming a plasma light source. The concave lamp body (11) has a reflecting surface (12). Electrodes (27, 28) are disposed external to the lamp body for producing radio frequency energy exciting the gas. A heat resistant glass plate (20) seals the concave lamp body (11). A frit seal (23) can be used for forming a pressure and temperature resistant seal between the concave lamp body (11) and the glass plate (20). The light beam generated by the plasma exists through the glass plate (20).

24 Claims, 4 Drawing Sheets

ELECTRODELESS LAMP WITH SEALED CERAMIC REFLECTING HOUSING

CROSS REFERENCE TO RELATED APPLICATIONS

The present application is a national stage application of PCT/US97/22304, filed Dec. 16, 1997, and a con of U.S. application Ser. No. 08/771,757, filed Dec. 20, 1996, now abandoned.

BACKGROUND OF THE INVENTION

1. Field of the Invention

The present invention relates to a high temperature, high efficiency lamp apparatus with an improved, frit sealed ceramic housing that produces a beam of light using a fill contained under pressure within the lamp housing interior that is energized with externally placed electrodes for vaporizing the gas to form a plasma. More particularly, the present invention relates to a projecting system that features a high temperature electrodeless lamp in which light energy is generated by a plasma contained inside a frit sealed ceramic body or housing that has a concave reflector surface surrounding the lamp body interior.

2. Description of the Related Art

High power lamps are used for illumination applications beyond typical incandescent and fluorescent lamps. One type of lamp known as a high intensity discharge (HID) lamp consists of a glass envelope which contains electrodes and a fill which vaporizes and becomes a gas when the lamp is operated.

Recently, a patent issued for a high power lamp that utilizes a lamp fill containing sulfur or selenium or compounds of these substances. U.S. Pat. No. 5,404,076, issued to Dolan, et al., and entitled "Lamp Including Sulfur" discloses an electrodeless lamp utilizing an excited fill. The Dolan, et al., U.S. Pat. No. 5,404,076 is incorporated herein by reference.

Projecting systems are used to display images on large surfaces, such as movie or television screens and computer displays. For example, in a front projection system, an image beam is projected from an image source onto the front side of a reflection-type angle transforming screen, which then reflects the light toward a viewer positioned in front of the screen. In a rear projection system, the image beam is projected onto the rear side of a transmission-type angle transforming screen and transmitted toward a viewer located in front of the screen.

In prior co-pending U.S. patent application Ser. No. 08/581,108, entitled "Projecting Images," to Knox, filed Dec. 29, 1995, now abandoned there is disclosed a method of displaying an optical image by projecting the image along an optical path and at an optical device interposed across the optical path, at one time reflecting the image from the optical device and at a different time permitting the image to pass through the optical device to be displayed. U.S. patent application Ser. No. 08/581,108, filed Dec. 29, 1995, now abandoned is incorporated herein by reference. A projection system for such a display is disclosed in U.S. application Ser. No. 08/730,818, entitled "Image Projection System Engine Assembly," to Knox, filed Oct. 17, 1996, which is hereby incorporated by reference.

The image source for a projection system employs a light that must be of high intensity and preferably very efficient. Such a light is disclosed in U.S. patent application Ser. No. 08/747,190, entitled "High Efficiency Lamp Apparatus for Producing a Beam of Polarized Light," to Knox, et al., filed Nov. 12, 1996, now U.S. Pat. No. 5,833,360 which is hereby incorporated by reference. If an optical image is to be displayed by projection, it sometimes passes through an optical device interposed across the optical path. In the projection system of prior co-pending application Ser. No. 08/581,108, filed Dec. 29, 1995, one or more optical devices reflect the image at one time from the optical device and at a different time permit the image to pass through the optical device to be displayed. There will be a decrease in light intensity once the optical image strikes the optical device interposed across the optical path. Therefore, in projection systems where an optical device is interposed across the optical path there is a need for a projection engine with a high intensity light of improved efficiency.

SUMMARY OF THE INVENTION

The present invention provides an improved high efficiency lamp apparatus for producing an intense beam of light using a plasma light source. The apparatus includes an electrodeless lamp body, preferably of ceramic or like heat resistant material. The lamp body has a concavity that surrounds a lamp interior.

A clear glass plate seals one end portion of the housing. A fill is contained within the lamp body interior. The fill is preferably sulfur or selenium or a combination thereof that can be excited to form a plasma light source.

The lamp body provides a concavity with a reflective surface thereon. Electrodes are positioned externally of the lamp body for producing radio frequency (or RF or Microwave) energy that enables the gas in the lamp body cavity to be excited and form the plasma light source that generates intense heat (about 800° C. to 1200° C.) and an intense light beam. As used herein, the term radio frequency means a frequency range sufficient to excite a fill in the bulb (e.g., about 150 MegaHertz to about 10 GigaHertz, or other suitable frequency.

The clear (e.g., glass, quartz, sapphire, or any optically clear material) plate seals the gas within the interior of the housing and allows light to escape the housing.

A frit seal can be used for a connection between the lamp body at its peripheral edge and the periphery of the glass lens. The glass lens is preferably a quartz plate or like material that is clear and which can withstand high temperature.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
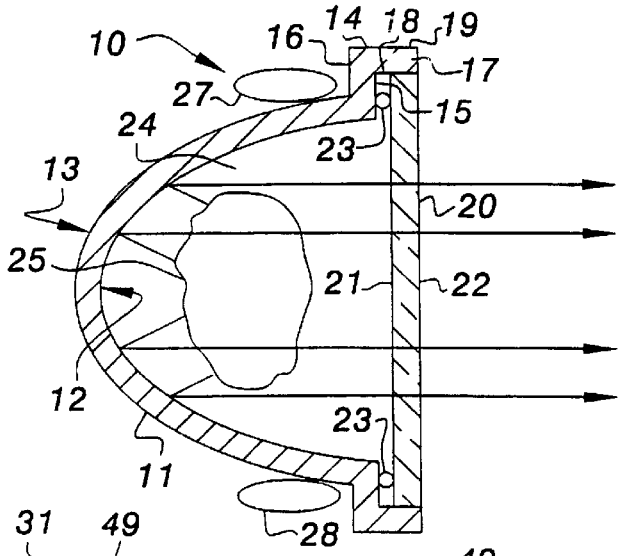
FIG. 1 is a sectional elevational view of a first embodiment of the lamp apparatus of the present invention.

FIG. 1 shows generally the first embodiment of the apparatus of the present invention designated generally by the numeral 10. Lamp apparatus 10 includes housing or body 11 having inner concave surface 12 and outer convex surface 13. Housing 11 provides an open end portion surrounded by annular flange 14 having inner flat surface 15 and outer surface 16. Annular shoulder 17 extends from annular flange 14. Annular shoulder 17 has inner surface 18 and outer surface 19. Housing 11 is preferably ceramic.

Clear circular plate 20 is preferably of an optically clear material that is heat resistant such as glass, quartz, or sapphire. Plate 20 is connected to lamp housing 11 at annular flange 14 and annular shoulder 17. Circular plate 20 has inner surface 21 and outer surface 22.

Figure 8A:
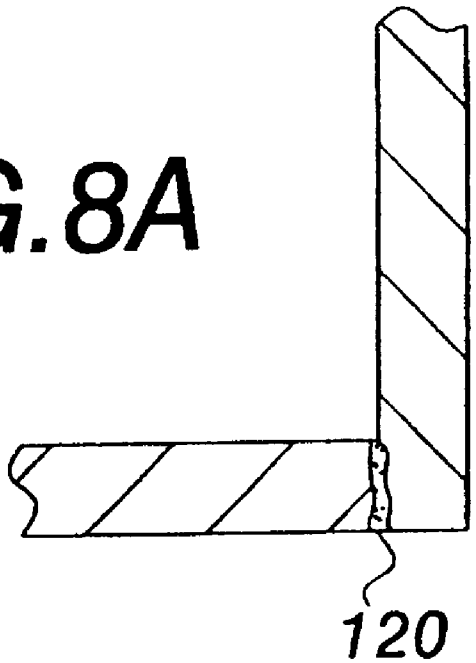
FIGS. 8A and 8B are a sectional elevational view showing an alternative seal.
Figure 8B:
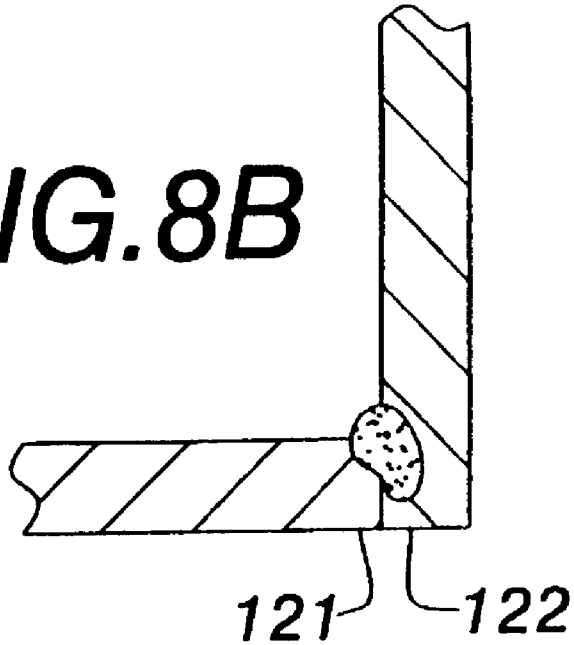

The connection between lamp housing 11 and circular plate 20 is perfected using frit seal 23 that is positioned in between annular flange 14 at surface 15 and circular plate 20 as shown in FIG. 1. A frit seal is a seal made by fusing together glass powders with a glass binder. However, seal 23 can also be a brazing seal or a direct bond type seal 120 (see FIG. 8A), melting the glass or a clear ceramic such as sapphire to the ceramic. Seal 23 could also be formed by metalizing that portion of the ceramic housing 11 and that portion of the plate 20 at the joint, then welding metal 121 to metal 122 at the metalized coatings (see FIG. 8B). A connection 30 is formed between plate 20 and housing 11.

An interior space 24 is defined by the concavity of housing 11 and circular plate 20. Interior 24 contains a fill medium such as a sulfur or selenium fill, or compounds of these substances. The gas contained within interior 24 is a fill that can be excited using radio frequency energy, for example, to form a plasma light source 25.

Electrodes 27 and 28 are shown in FIG. 1, positioned externally of lamp housing 11 and spaced away from the outer surface 13 of housing 11. Electrodes 27, 28 are thus not subjected to the intense heat of plasma light source 25.

Reflecting surface 12 can be a high reflectivity ceramic surface, preferably a diffuse reflection (e.g., white ceramic). This produces a collimating lamp apparatus 10 that generates light rays 29 that are generally parallel. A variety of shapes are possible other than the curved shape of housing 11 and square shape of housing 32 of FIG. 2. Different shapes can be employed to force the plasma itself into different shapes or to provide different sealing properties between the clear material and the ceramic.

Figure 2:
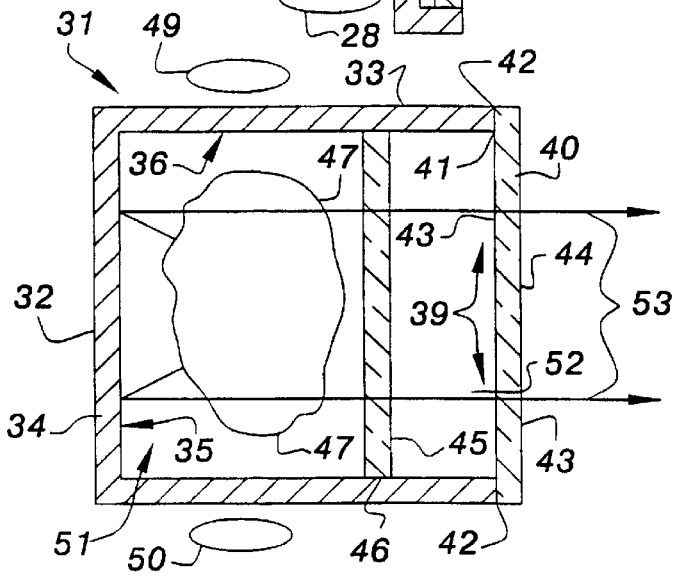
FIG. 2 is a sectional elevational view of a second embodiment of the lamp apparatus of the present invention.

FIG. 2 discloses a second embodiment of the lamp apparatus of the present invention, designated generally by the numeral 31. Lamp apparatus 31 provides a housing 32 that has cylindrically shaped side wall 33 and flat circular end wall 34 that are integrally formed. Housing 32 can be of a heat resistant material such as ceramic.

Inside flat surface 35 is provided at circular end wall 34. Cylindrical shaped inner surface 36 is formed at cylindrically side wall 33. Outer surfaces 37, 38 are also shown in FIG. 2 as being respectively circular and cylindrical in shape.

Lamp housing 32 has an open end 39 that is covered with a circular filter 40, such as a polarizing filter. Circular filter 40 has a peripheral surface 41 that forms a connection at 42 with lamp housing 32. Filter 40 has an inside surface 43 and an outer surface 44. Inside surface 43 connects to peripheral surface 41 of housing 32 at connection 42. Connection 42 preferably includes a frit seal. However, seal 42 can also be a brazing seal or a direct bond type seal, melting the glass to the ceramic. Seal 42 could also be formed by metalizing that portion of the ceramic housing 32 and that portion of the filter 40 at the joint, then welding metal to metal at the metalized coatings. A connection 30 is formed between filter 40 and housing 32.

A second plate 45 is positioned in between a plasma light source 47 and a filter 43. Plate 45 is preferably an optically clear plate of high temperature resistant material, such as quartz, sapphire, or the like. Connection 46 designates a connection between plate 45 and cylindrical inner surface 36 of housing 32.

Plasma light source 47 is formed within an interior 51 of housing 32. Interior 51 contains a fill (such as sulfur, selenium, or compounds thereof) that can be excited to form plasma light source 47. Plasma light source 47 is not a well defined ball, but occupies the central area of interior 51.

A pair of electrodes 49, 50 provide radio frequency energy that can excite the gas with interior 51 to form plasma light source 47. Interior 52 of housing 32 is that space between filter 43 and glass plate 45. Interior 52 is filled with a gaseous substance that forms an insulation layer between plate 45 and plate 43.

Plate 43 can be a polarizing film filter that may not be able to withstand the intense heat generated within interior 51 of lamp housing 32. Therefore, insulating gaseous layer 52 is provided in between plates 43 and 45 to prevent heat damage to film plate 43. Light rays 53 are shown in FIG. 2 as being emitted from lamp housing 32, passing through glass plate 45 and filter 43. In the embodiment of FIG. 2, the light 53 is polarized having passed through the polarizing filter 43.

Figure 3:
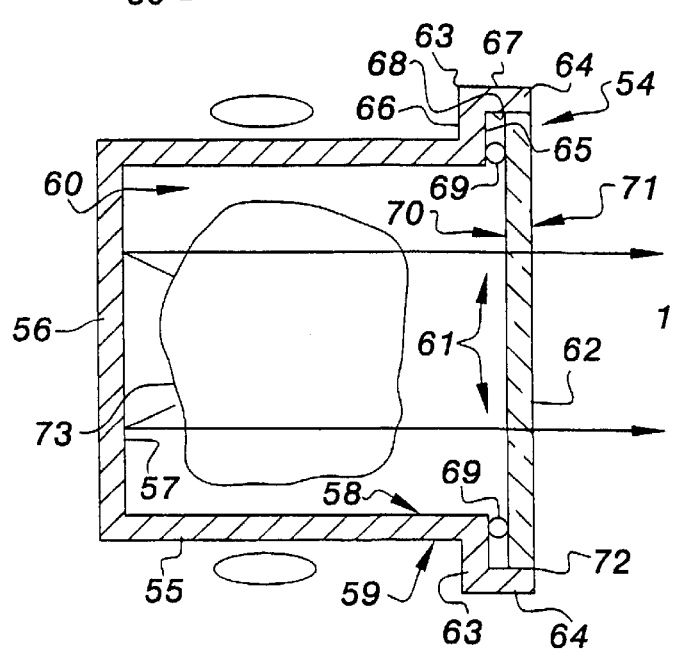
FIG. 3 is a sectional elevational view of a third embodiment of the lamp apparatus of the present invention.

In FIG. 3, a third embodiment of the apparatus of the present invention is shown, designated by the numeral 54. Lamp apparatus 54 has cylindrical housing 55, that includes flat circular end wall 56, inside flat surface 57, inside cylindrical surface 58, and outer surface 59. The surfaces 57, 58 define with circular plate 62 an interior 60 for containing a fill that can be excited (such as sulfur or selenium gas or compounds thereof) to form plasma light source 73. Lamp housing 55 has open end 61 that is covered by circular plate 62. Plate 62 has inner surface 70 and outer surface 71.

Housing 55 provides peripheral flange 63 and annular shoulder 64. Flange 63 has inner surface 65 and outer surface 66. Annular shoulder 64 has outer surface 67 and inner surface 68. Frit seal 69 forms a seal in between plate 62 and annular flange 63. A connection 72 is formed in between the annular shoulder 64 and plate 62.

Plasma light source 73 is formed within gas containing interior 60 by energy from electrodes 75, 76. Electrodes 75 and 76 are shown in FIG. 3 positioned externally of the lamp interior so that they are not subjected to the intense heat generated by plasma light source 73. Light rays 77 are shown exiting lamp apparatus 54.

Figure 4:
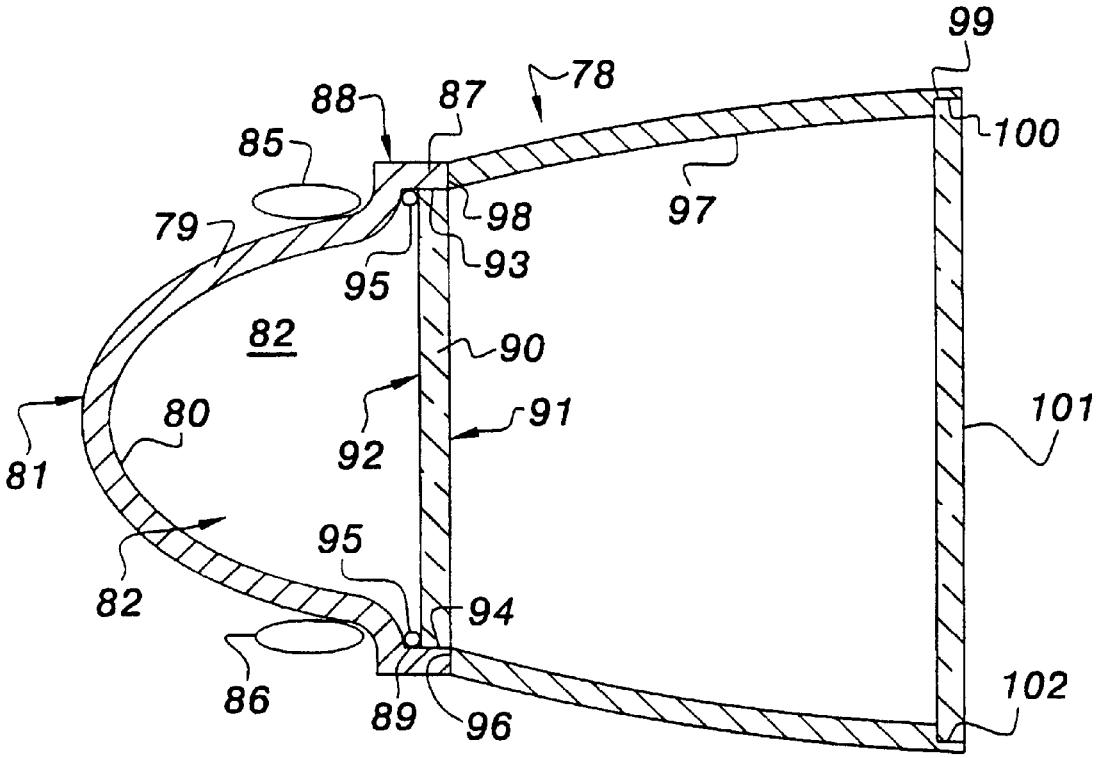
FIG. 4 is sectional elevational view of a fourth embodiment of the lamp apparatus of the present invention.
Figure 5:
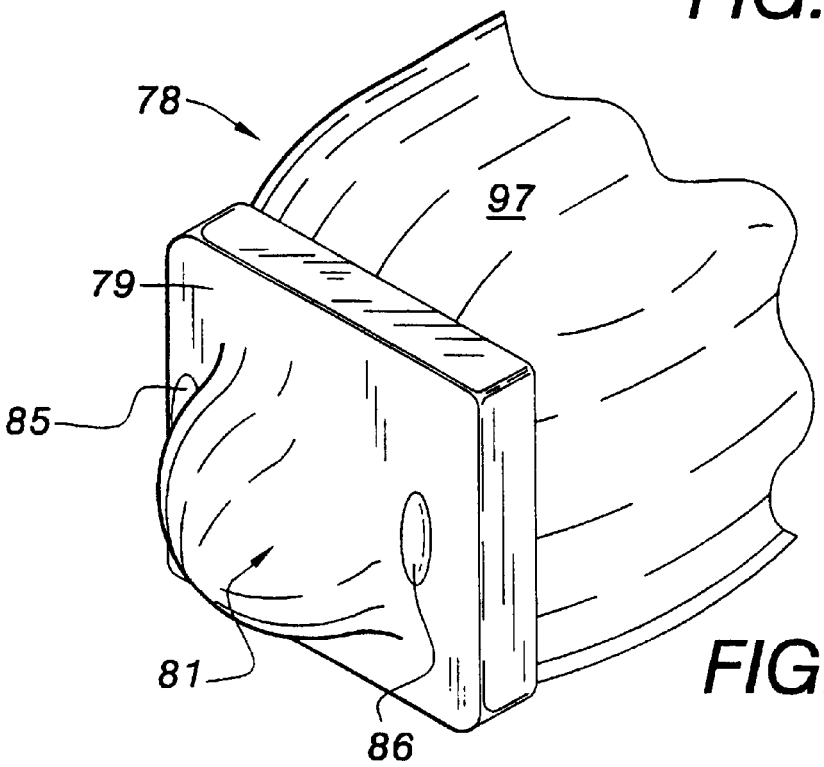
FIG. 5 is a partial perspective view of the fourth embodiment of the lamp apparatus of the present invention.

In FIGS. 4 and 5, a fourth embodiment of the apparatus of the present invention is shown designated by the numeral 78. Lamp apparatus 78 includes a housing or body (preferably ceramic) 79 having a concave reflective surface 80, an outer convex surface 81 and an interior 82. Interior 82 contains a fill medium such as sulfur, selenium, or compounds thereof, that can be excited to form a plasma light source 83.

Electrodes 85 and 86 are positioned externally of lamp housing 79 so that they are not subjected to the intense heat of plasma heat source 83. Peripheral flange 87 is provided having outer surface 88 and inner surface 89. Clear plate 90 can be of a heat resistant glass such as quartz. Plate 90 has outer surface 91 and inner surface 92. Peripheral edge 93 of clear plate 90 forms a connection at 94 with lamp housing 79. Frit seal 95 is positioned in between lamp housing 79 and plate 90 as shown in FIG. 4. Lamp housing 79 provides flat peripheral surface 96 that forms a connection with reflector 97. Reflector 97 also has a flat corresponding surface 98 that forms a connection with flat surface 96. Reflector 97 has peripheral edge 99 with recess 100 that receive filter 101. Filter 101 has peripheral edge 102 that forms a connection with shade 97 at recess 100.

Figure 6:
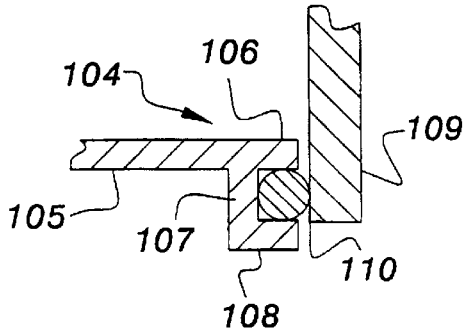
FIGS. 6–7 are sectional elevational views of the fifth and sixth embodiment of the apparatus of the present invention showing additional seal geometries.
Figure 7:
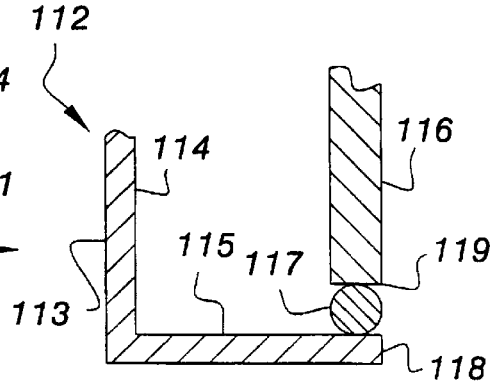

FIGS. 6 and 7 show additional geometries for the frit seal type seal of FIG. 3. In FIG. 6, an alternate version of the apparatus 54 of FIG. 3 is shown with a different seal configuration. Lamp 104 is constructed as lamp 54 in FIG. 3 but for the seal geometry. In FIG. 6, housing 105 is shaped as housing 55 in FIG. 3. However, the members 63, 64 differ in geometry. Housing 105 has a seal arrangement that includes a frit seal 110 positioned in between the plate 109 in FIG. 6 (that corresponds to the plate 62 of FIG. 3) and the plurality of flanges 106, 107, 108. The flanges 106, 107, 108 form a C-shaped annular member that receives the seal 110.

In FIG. 7, plate 116 corresponds to the plate 62 in FIG. 3. The housing 113 corresponds to the housing 55 of FIG. 3, but differs in geometry at the seal 116. In the embodiment of FIG. 7, lamp 112 includes a housing 113 having annular flanged portions 114, 115 that intersect at about ninety degrees relative to one another. A seal 117 can be a frit seal positioned in between annular edge 118 of annular flange 115 and the peripheral edge 119 of plate 116. Each of the seals of FIGS. 6 and 7 can be frit seals or brazed or welded. If welded, the surfaces of housings 105, 113 and the surfaces 109, 116 are first metalized so that metal to metal surfaces are provided for welding.

Figures 9, 10:
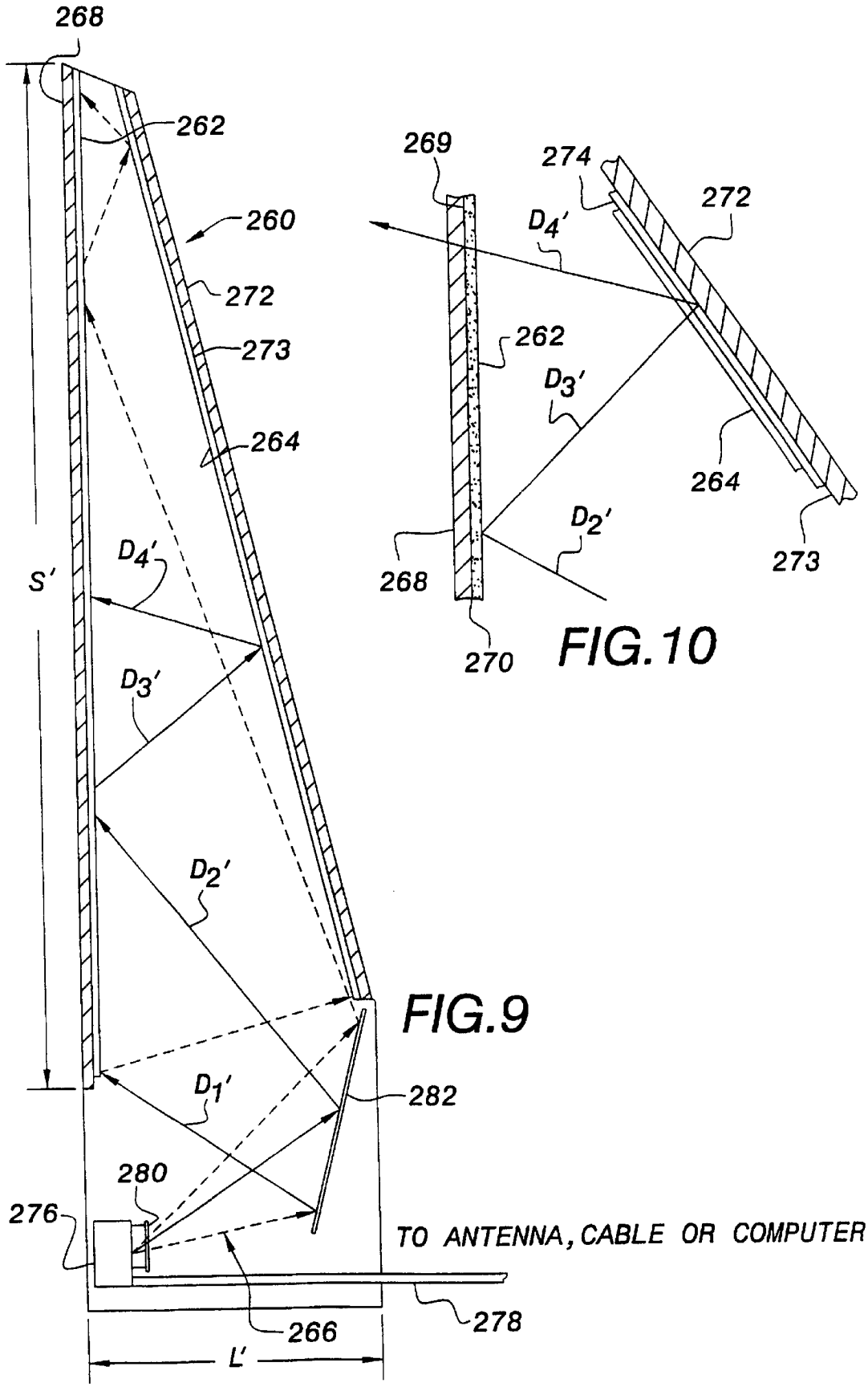
FIGS. 9 and 10 are side views of a system suitable for use of the apparatus according to the invention.

FIGS. 9 and 10 show a rear projection video system 260 that includes a linear reflecting polarizer 262 and an achromatic retarder 264 that allow light in a projected image 266 to reflect from a display screen 268 at one instance and to pass through the screen 268 at another instance. This allows for "optical folding," which allows the video system 260 to be very shallow yet project a large image, as described in the previously incorporated U.S. patent application entitled "Projecting Images." For the video system 260 to work properly, the image source 276 must produce polarized light. A wide variety of other types of video systems employ polarization in image formation.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A collimating high intensity discharge lamp apparatus, comprising:

a) an electrodeless hollow lamp body with an open end;

b) a clear closure plate that covers the open end of the lamp body;

c) a seal that holds the clear closure plate to the lamp body so that the lamp body, the clear closure plate and the seal define a sealed chamber; and d) a fill contained within the sealed chamber which can be excited to form a plasma having a temperature above about 800° C. which emits light;

e) wherein the lamp body includes an inner reflecting surface for reflecting and collimating light emitted by the plasma to form parallel rays of light exiting the open end of the lamp body through the clear closure plate, and wherein the lamp body and the closure plate are made of suitable materials to withstand the temperature of the plasma during operation.

2. The collimating lamp apparatus of claim 1, wherein the lamp body is ceramic.

3. The collimating lamp apparatus of claim 2, wherein the seal holding the clear closure plate to the lamp body comprises a frit seal.

4. The collimating lamp apparatus of claim 2, wherein the seal holding the clear closure plate to the lamp body comprises a weld.

5. The collimating lamp apparatus of claim 2, wherein the seal holding the clear closure plate to the lamp body comprises a direct bond.

6. The collimating lamp apparatus of claim 1, wherein the clear closure plate is quartz.

7. A high intensity discharge lamp apparatus, comprising:

a) an electrodeless ceramic lamp body in the form of concave walled shell;

b) a clear light transmitting plate member fastened to the lamp body at a periphery thereof, the plate member and lamp body defining a chamber;

c) a connection for holding the plate member and lamp body together;

d) the connection including a frit seal positioned in between the plate member and lamp body;

e) the chamber containing a fill that can be excited to form a plasma having a temperature above about 800° C. which emits light; and f) wherein the lamp body includes an inner reflecting surface for reflecting light emitted by the plasma and the light emitted by the plasma exits the lamp body through the plate member, and wherein the lamp body and the plate member are made of suitable materials to withstand the temperature of the plasma during operation.

8. The lamp apparatus of claim 7, wherein the lamp body comprises flat circular and cylindrically shaped wall portions.

9. The lamp apparatus of claim 7, wherein the lamp body and plate member continuously abut along the periphery of the lamp body.

10. The lamp apparatus of claim 7, wherein the lamp body comprises a concave walled portion and a peripheral portion with a flange.

11. The lamp apparatus of claim 10, wherein the clear plate member attaches to the lamp body at the flange.

12. The lamp apparatus as recited in claim 11 further comprising a reflector attached to the lamp body at the flange.

13. The lamp apparatus of claim 7, wherein the inner reflecting surface comprises a diffusely reflecting surface producing generally parallel rays of light exiting the plate member.

14. An electrodeless lamp bulb envelope for a high intensity discharge lamp, comprising:

a light transmissive segment;

a reflective segment integrally joined with the light transmissive segment, wherein the light transmissive segment and the reflective segment together define a sealed interior volume of the lamp bulb envelope with no interior electrodes; and a fill disposed in the sealed interior volume of the lamp bulb envelope which can be excited to emit light from a plasma having a temperature above about 800° C., wherein the reflective segment comprises an inner reflecting concave surface for directing light emitted by the fill through the light transmissive segment, and wherein the light transmissive segment and the reflective segment are made of suitable materials to withstand the temperature of the plasma during operation.

15. The lamp bulb envelope as recited in claim 14, wherein the inner reflecting concave surface collimates the light into generally parallel rays exiting through the light transmissive segment.

16. The lamp bulb envelope as recited in claim 14, wherein the reflective segment comprises ceramic.

17. The lamp bulb envelope as recited in claim 14, wherein the light transmissive segment comprises quartz.

18. The lamp bulb envelope as recited in claim 14, wherein the reflective segment comprises ceramic, the light transmissive segment comprises quartz, and the light transmissive segment and the reflective segment are joined to each other at a connection point therebetween.

19. The lamp bulb envelope as recited in claim 18, wherein the light transmissive segment and the reflective segment are joined by a frit seal.

20. The lamp bulb envelope as recited in claim 18, wherein the light transmissive segment and the reflective segment are joined by a weld.

21. The lamp bulb envelope as recited in claim 18, wherein the light transmissive segment and the reflective segment are joined by a direct bond.

22. The lamp bulb envelope as recited in claim 18, wherein the reflective segment comprises a lamp body which defines an opening having a peripheral edge and wherein the light transmissive segment comprises a clear plate member attached to the peripheral edge of the opening.

23. The lamp bulb envelope as recited in claim 18, wherein the reflective segment comprises a lamp body having a concavity and an open end and wherein the light transmissive segment comprises a clear plate member connected to the open end of the lamp body.

24. The lamp bulb envelope as recited in claim 23, wherein the lamp body includes a generally cylindrically shaped portion.

* * * * *